US008919588B2

(12) United States Patent
Tai

(10) Patent No.: US 8,919,588 B2
(45) Date of Patent: Dec. 30, 2014

(54) APPARATUS FOR FASTENING AND CARRYING BOTTLES

(76) Inventor: Hsueh-Lee Tai, Keelung (TW)

( * ) Notice: Subject to any disclaimer, the term of this patent is extended or adjusted under 35 U.S.C. 154(b) by 0 days.

(21) Appl. No.: 13/584,207

(22) Filed: Aug. 13, 2012

(65) Prior Publication Data

US 2013/0068718 A1 Mar. 21, 2013

(30) Foreign Application Priority Data

Sep. 20, 2011 (TW) ..... 100217579 U

(51) Int. Cl.

| | |
|---|---|
| ***B65D 23/10*** | (2006.01) |
| ***B65D 21/024*** | (2006.01) |
| ***B65D 21/02*** | (2006.01) |
| ***B65D 71/02*** | (2006.01) |
| ***B65D 63/10*** | (2006.01) |

(52) U.S. Cl.

CPC ..... *B65D 21/0201* (2013.01); *B65D 71/02* (2013.01); *B65D 63/1027* (2013.01); *Y10S 215/901* (2013.01)

USPC ..... 215/396; 215/274; 215/352; 215/345; 215/901; 220/319; 220/212.5; 220/710.5; 220/375; 220/318

(58) Field of Classification Search

CPC .... B65D 23/10; B65D 23/102; B65D 23/104; B65D 41/3419; B65D 41/34; B65D 33/06; B65D 33/065; B65D 33/08

USPC ..... 220/212.5, 710.5, 752, 318, 375; 215/396, 375, 274, 352, 345; 206/139, 206/145, 147, 150; 294/33; 426/397; 248/315

See application file for complete search history.

(56) References Cited

U.S. PATENT DOCUMENTS

| | | | | | |
|---|---|---|---|---|---|
| 2,611,639 | A * | 9/1952 | Sadeck | 294/87.2 |
| 2,781,960 | A * | 2/1957 | Dick | 294/27.1 |
| 5,203,481 | A * | 4/1993 | Dobbins et al. | 224/148.4 |
| 5,447,259 | A * | 9/1995 | Erickson | 220/759 |
| 5,938,256 | A * | 8/1999 | Lovette | 294/87.2 |
| 6,076,874 | A * | 6/2000 | Lovette | 294/87.2 |
| 6,086,124 | A * | 7/2000 | Wang | 294/33 |
| 6,196,403 | B1 * | 3/2001 | Yamaguchi | 215/396 |
| 6,571,429 | B2 * | 6/2003 | Yeh | 24/16 PB |
| 7,228,982 | B2 * | 6/2007 | Nielson | 215/396 |
| 8,313,132 | B2 * | 11/2012 | Kuzma et al. | 294/159 |
| 8,316,509 | B1 * | 11/2012 | Thomson et al. | 16/422 |
| 8,371,244 | B2 * | 2/2013 | Krasner | 119/72.5 |
| 8,443,993 | B1 * | 5/2013 | Desselle | 215/306 |

(Continued)

FOREIGN PATENT DOCUMENTS

| | | |
|---|---|---|
| TW | 530807 | 5/2003 |
| TW | M284152 | 12/2005 |

(Continued)

*Primary Examiner* — Robert J Hicks
*Assistant Examiner* — Kareen Rush
(74) *Attorney, Agent, or Firm* — Ming Chow; Sinorica, LLC

(57) ABSTRACT

An apparatus for fastening and carrying bottles includes a cap ring and a connecting device. The cap ring has at least an opening. The cap ring is received in a cavity of the bottle. The cap ring is initially connected to the cap, and the cap ring is separated from the cap while the cap is turned to open. The connecting device engages the opening of the cap ring to allow people to carry the bottle by holding the connecting device or by engaging the connecting device with an object. The apparatus has many advantages, including never loss, low cost for manufacture, and recycle.

6 Claims, 10 Drawing Sheets

(56) References Cited

U.S. PATENT DOCUMENTS

| | | | | |
|---|---|---|---|---|
| 8,443,994 | B1 * | 5/2013 | Desselle | 215/306 |
| 8,522,997 | B2 * | 9/2013 | Lane et al. | 220/375 |
| 2002/0084240 | A1 * | 7/2002 | Yu-Hsien | 215/258 |
| 2002/0084241 | A1 * | 7/2002 | Yu-Hsien | 215/305 |
| 2007/0221607 | A1 * | 9/2007 | Piccioli et al. | 215/396 |
| 2008/0245763 | A1 * | 10/2008 | Chalekian et al. | 215/396 |

FOREIGN PATENT DOCUMENTS

| | | |
|---|---|---|
| TW | M334101 | 6/2008 |
| TW | M368980 | 5/2009 |
| TW | I360208 | 3/2012 |

* cited by examiner

APPARATUS FOR FASTENING AND CARRYING BOTTLES

The current application claims a foreign priority to the patent application of Taiwan No. 100217579 filed on Sep. 20, 2011.

BACKGROUND OF THE INVENTION

1. Field of the Invention

The present invention relates generally to a fastening apparatus for bottles, and more particularly to an apparatus for fastening bottles with which user may hold the apparatus to carry the bottles. The fastening apparatus has many functions, including never loss, low cost, and recycle.

2. Description of the Related Art

Plastic bottles are widely used in the market to contain liquid. These plastic bottles, especially for PET bottles, are simply a bottle with a cap to seal a top opening of the bottle. It is very inconvenient for user to carry it. The conventional plastic bottle has the following drawbacks:

1. People usually hold the bottle by hand, and people will feel tired after holding the bottle for a long time. Sometime, people may drop the bottle as well.

2. People might have trouble to firmly hold the bottle when it is a big bottle or he/she has a small palm.

3. It is hard for one to hold several bottles in the same time.

4. The bottle will have water on it when the bottle is just taken out from refrigerator. People are unwilling to put the wet bottle in bag. The cold bottle is hard for people to hold it directly as well.

A carrying device is provided for user to carry single bottle. Such carrying device is taught in Taiwan patents M334101 and 368980. The carrying device is designed for one bottle, and it can't carry two or more bottles. Besides, the device surrounds the cap so that it might unfasten the cap when user carries the bottle by the device.

Taiwan patents 284152, 360208, and 530807 taught a carrying device for multiple bottles. However, user has to buy the device. The device is unrecyclable and user might lose it. Another drawback of such device is that the price of the device is too high because of its complex structure.

Taiwan patent 284152 taught a bottle fastener, however, it can't allow people to carry the bottles. Furthermore, the price of the fastener is too high because of the complex structure.

Therefore, it still has some portions to be improved in the conventional devices.

SUMMARY OF THE INVENTION

The primary objective of the present invention is to provide an apparatus for user to fasten bottles and carry these bottles.

The secondary objective of the present invention is to provide an apparatus for fastening and carrying bottles, which has low cost and is recyclable.

To achieve the objective of the present invention, an apparatus for fastening and carrying bottles includes a cap ring and a connecting device. The cap ring has at least an opening. The cap ring is received in a cavity of the bottle. The cap ring is initially connected to the cap, and it is separated from the cap while the cap is turned to open. The connecting device engages the opening of the cap ring to allow people to carry the bottle by holding the connecting device or by engaging the connecting device with an object.

The preset invention has many advantages, including never loss, low cost for manufacture, and recycle.

DETAILED DESCRIPTION OF THE INVENTION

Figure 1:
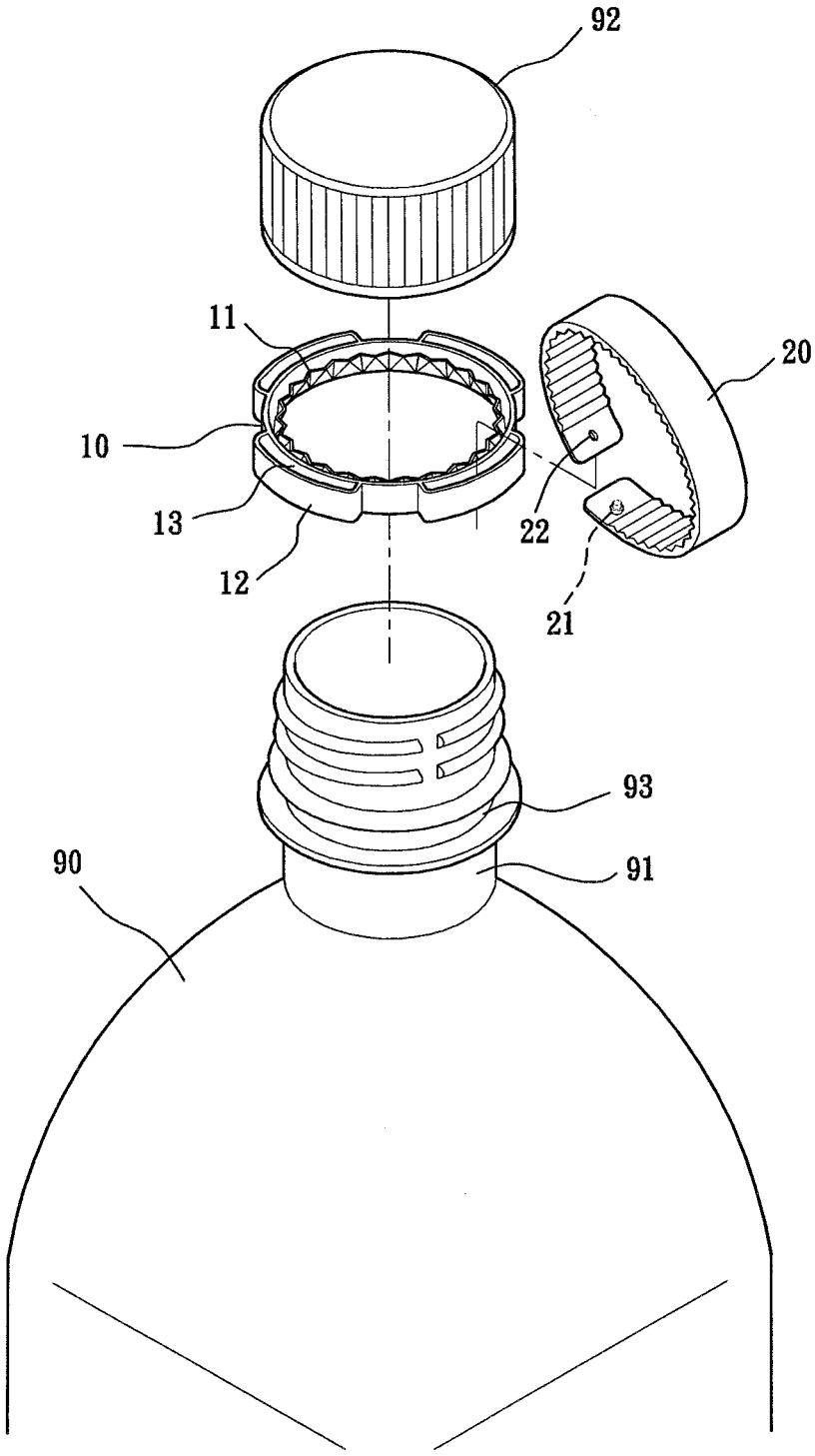
FIG. 1 is an exploded view of a first preferred embodiment of the present invention.
Figure 2:
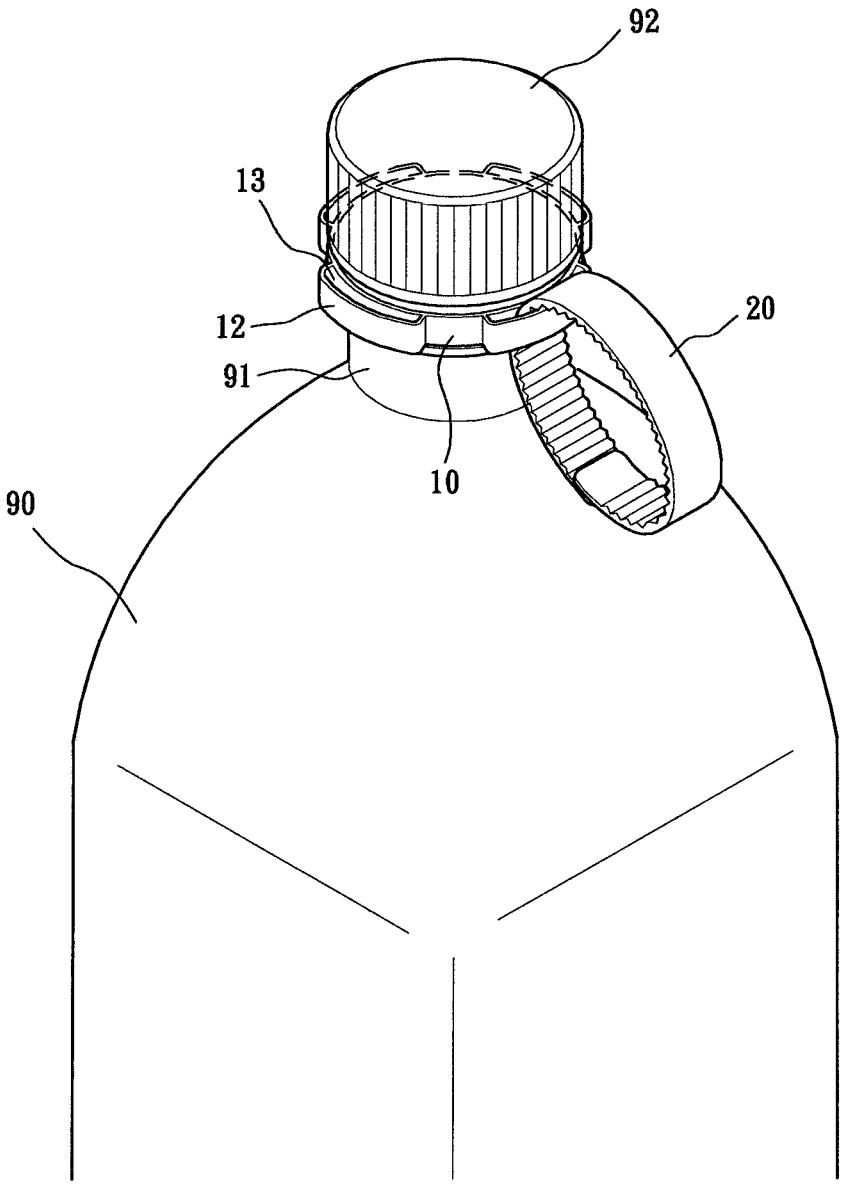
FIG. 2 is a perspective view of the first preferred embodiment of the present invention.
Figure 5:
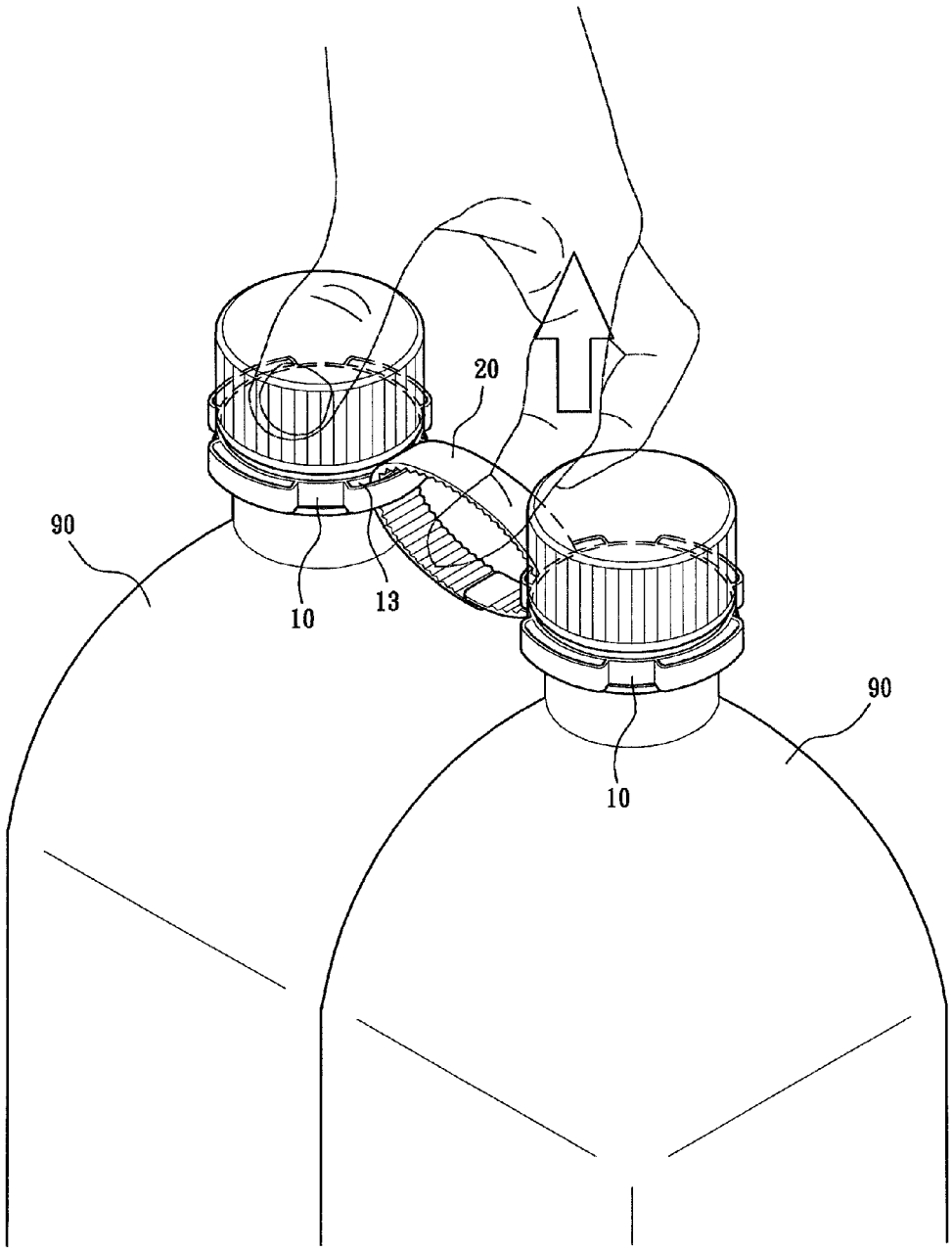
FIG. 5 is a perspective view of the first preferred embodiment of the present invention, showing user holding the connecting device.
Figure 6:
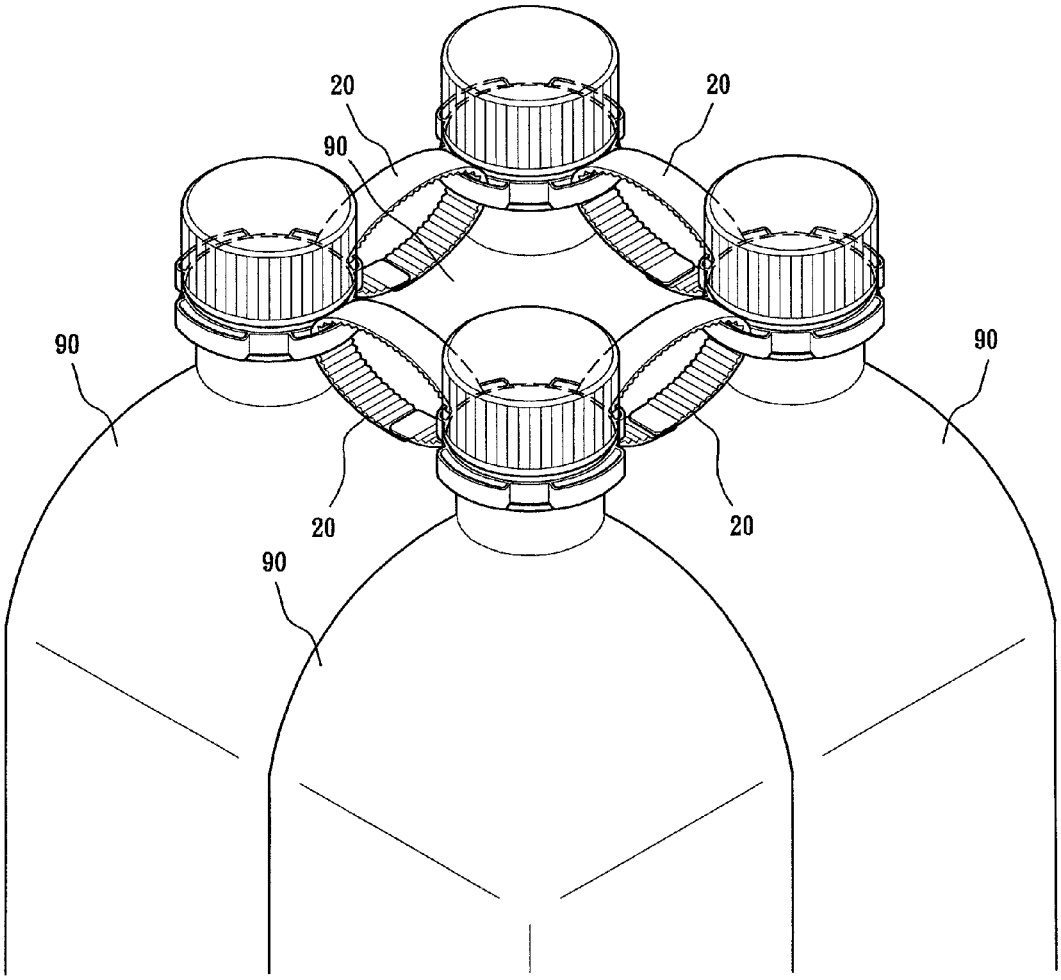
FIG. 6 is a perspective view of the first preferred embodiment of the present invention, showing four bottles being connected.

As shown in FIG. 2, an apparatus for fastening and carrying bottles of the first preferred embodiment includes a cap ring 10 mounted on a bottle 90 and a connecting device 20 detachably connected to the cap ring 10. The connecting devices 20 may connect the cap rings 10 on the bottles 90 in series (as shown in FIG. 5 and FIG. 6) or connect the bottle 90 to a predetermined object (not shown).

As shown in FIG. 1 to FIG. 4, the bottle 90 is a conventional plastic bottle having a neck portion 91 and a cap 92. The bottle 90 has a cavity 93 on the neck portion 91 under threads for engaging the cap 92. The cap ring 10 is received in the slot 93.

The cap ring 10 has a positioning member 11 at an inner side thereof. The positioning member 11 is a continuously bent ring projected from the inner side of the cap ring 10. An acute included angle between the positioning member 11 and the cap ring 10 make the cap ring 10 can't escape from the slot 93 of the bottle 90 after the cap ring 10 drops into the cavity 93. The cap ring 10 has four U-shaped ribs 12 on an outside side thereof to form openings 13 within the ribs 12. The cap ring 10 is initially connected to the cap 92, and they will be separated when user gives a torque to turn the cap 92. The cap ring 10 will remain in the cavity 93 of the bottle 90 anyway.

The connecting device 20 is a strip-like member made of plastic, rubber or metal, and the connecting device 20 is flexible. The connecting device 20 has teeth at an inner side. The connecting device 20 is provided with a post 21 and a bore 22 at opposite ends so that the connecting device 20 may be changed into a ring by the engagement of the post 21 and the bore 22. The strip-like connecting device 20 may pass through the opening 13 of the cap ring 10, and then its opposite ends is engaged to form the ring-like connecting device 20.

Figure 3:
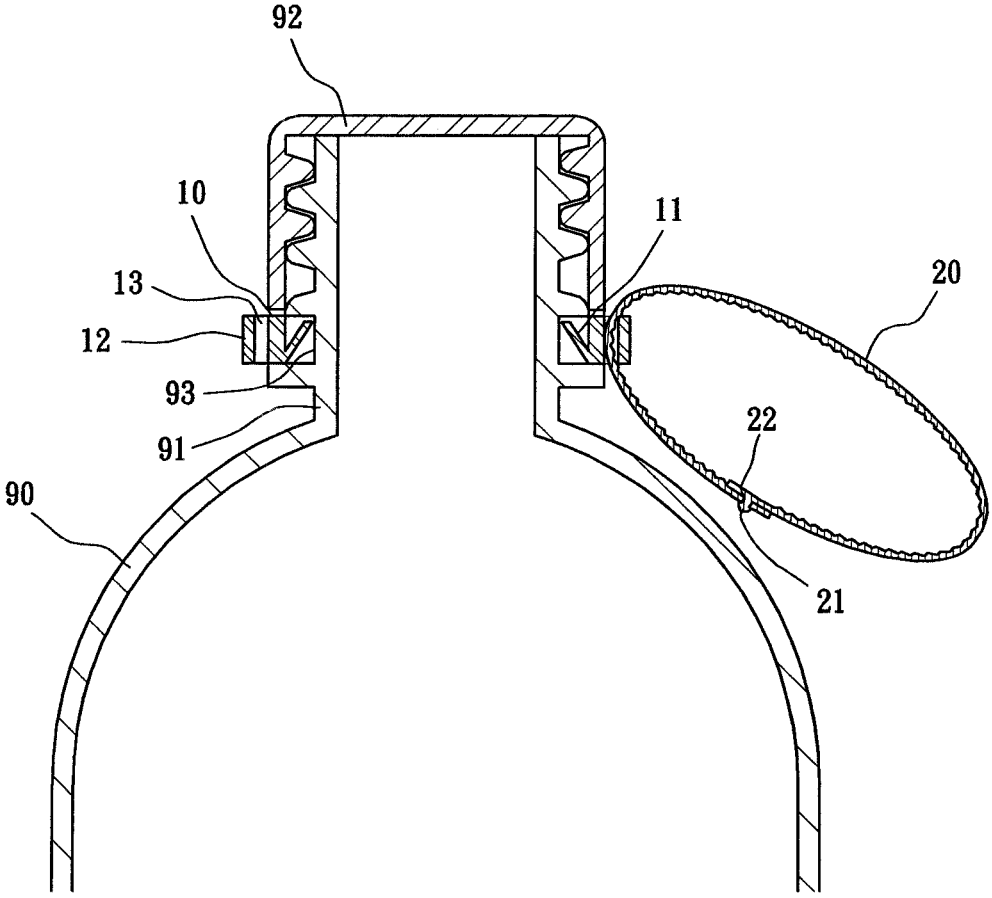
FIG. 3 is a sectional view of the first preferred embodiment of the present invention.

As shown in FIG. 2 and FIG. 3, the connecting device 20 is coupled to the cap ring 10 so that user may hold the ring-like connecting device 20, or engage the connecting device 20 with an object, such as a backpack, to carry the bottle 90. It is noted that the cap ring 10 is initially mounted on the bottle 90 in the factory so that it will not lose, and it is recyclable. User only needs to get the connecting device 20 or anything like that to achieve the function of the present invention.

Figure 4:
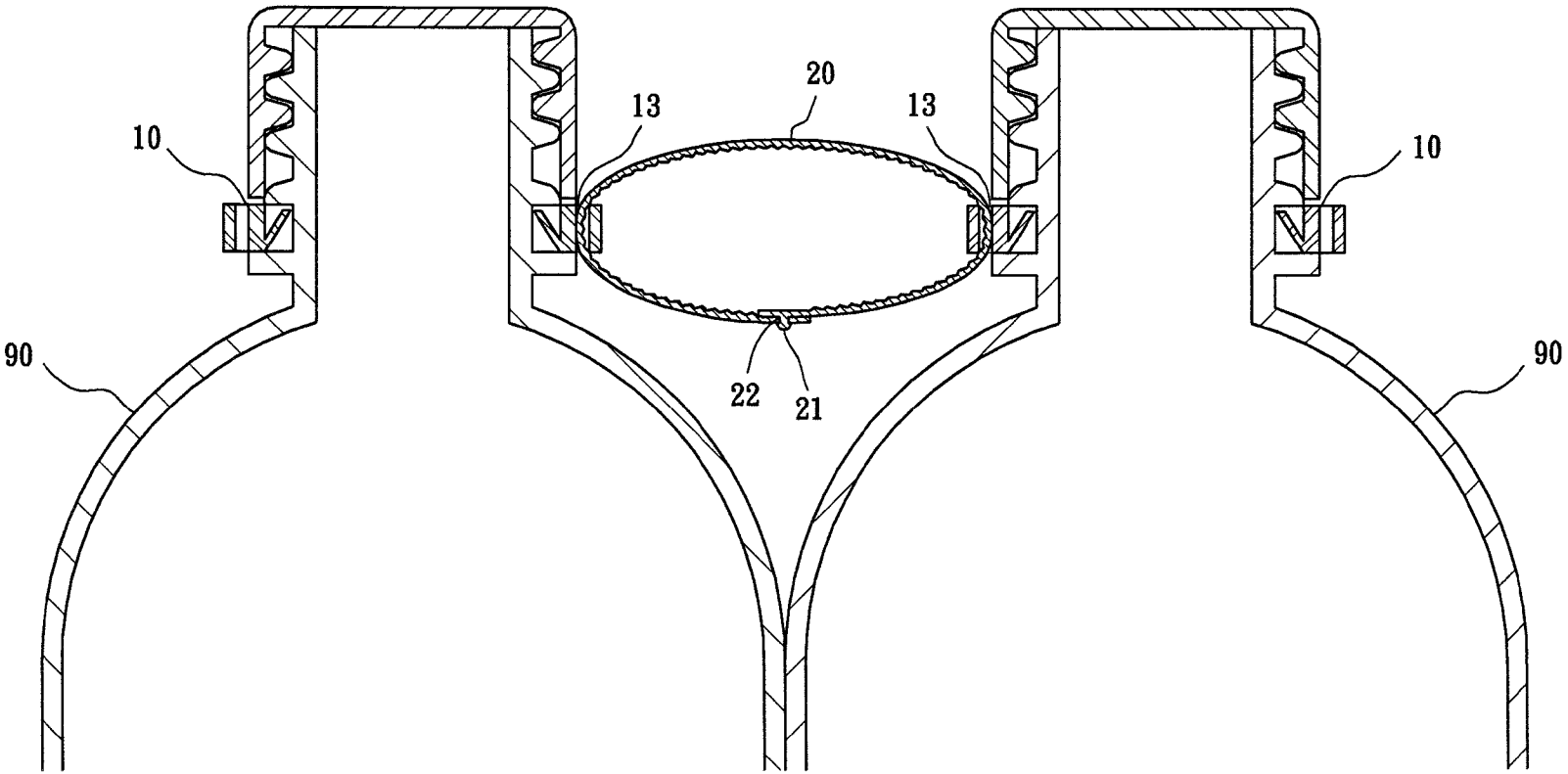
FIG. 4 is a sectional view of the first preferred embodiment of the present invention, showing the connecting device connecting two bottles.

As shown in FIG. 4 and FIG. 5, to couple the connecting device 20 to the cap ring 10, the post 21 and the bore 22 are disengaged to make the strip-like connecting device 20 to pass through the opening 13 of the cap ring 10 of a bottle 90 and the opening 13 of the cap ring 10 of another bottle 90, and then reengage the post 21 with the bore 22 to form the ring-like connecting device 20. At this time, the connecting device 20 will connect two bottles 90, and user may hold the connecting device 20 to carry two bottles 90 by one hand.

As shown in FIG. 5 and FIG. 6, with the same step as described above we can serially connect the bottles 90 by the connecting devices 20. It may connect the bottles 90 in a loop as shown in FIG. 6.

Figure 7:
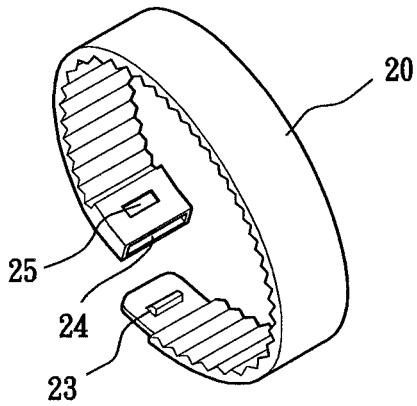
FIG. 7 is a perspective view of the connecting device of a second preferred embodiment of the present invention.

FIG. 7 shows a connecting device 20 of the second preferred embodiment, which has a plug at an end and a socket 24 at the other end. The connecting device 20 of the second preferred embodiment further has a protrusion 23 on the plug and a slot 25 communicated with the socket 24. The plug is inserted into the socket 24 and the protrusion 23 engages the slot 25 to secure the connecting device 20 in a ring shape. The way of operating the connecting device 20 and the function thereof are the same as above.

Figure 8:
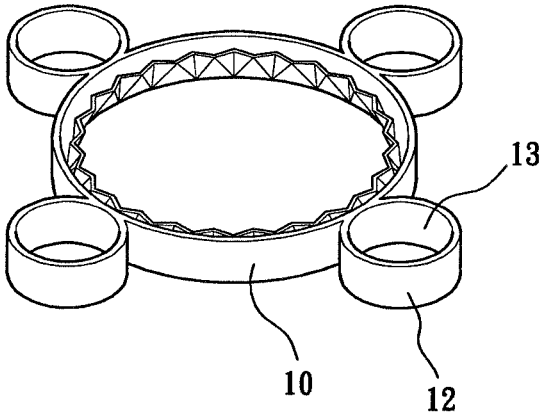
FIG. 8 is a perspective view of the cap ring of the second preferred embodiment of the present invention.

FIG. 8 shows a cap ring 10 of the second preferred embodiment, which has four ring-shaped ribs 12 to form four opening 13.

Figure 9:
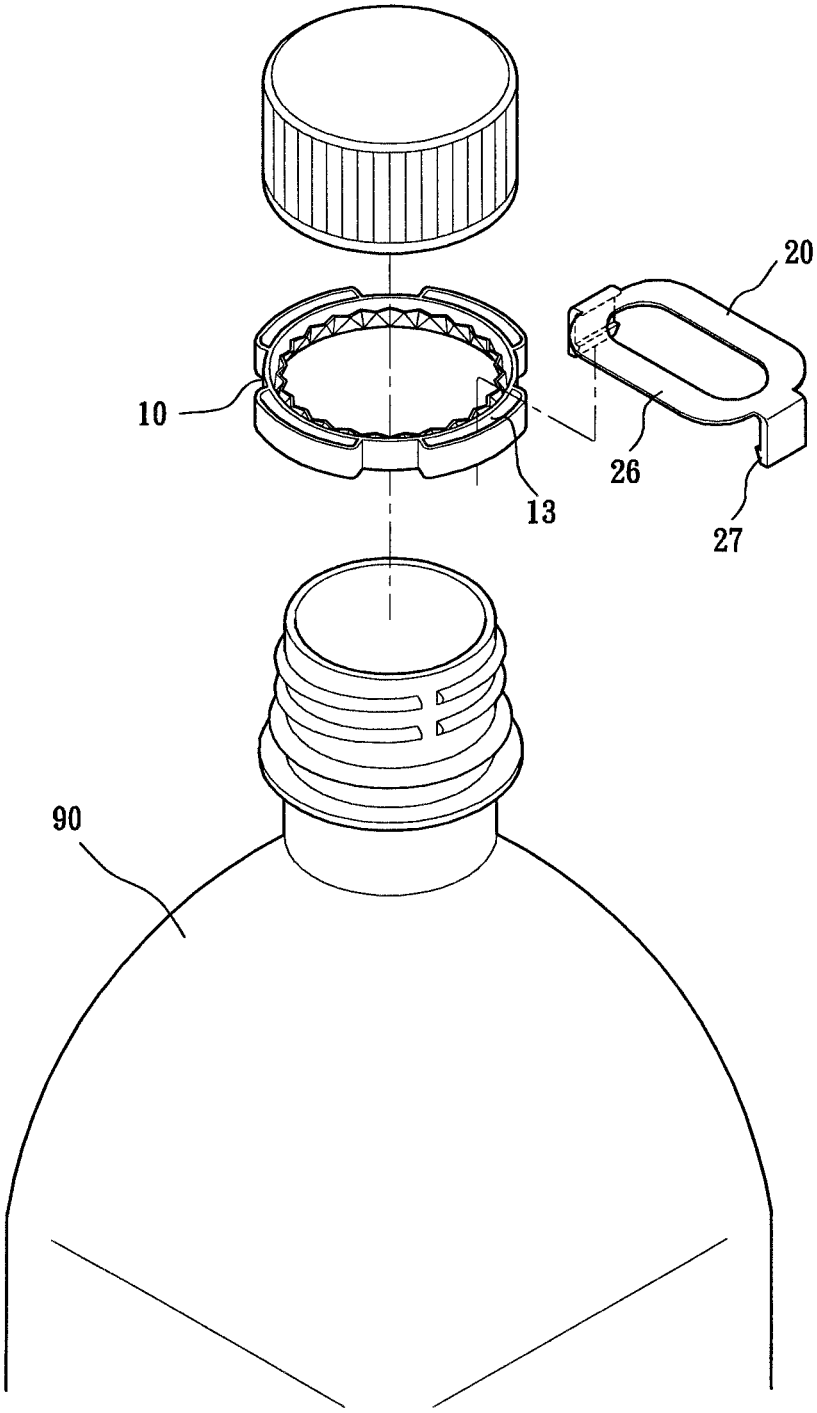
FIG. 9 is an exploded view of a third preferred embodiment of the present invention.
Figure 10:
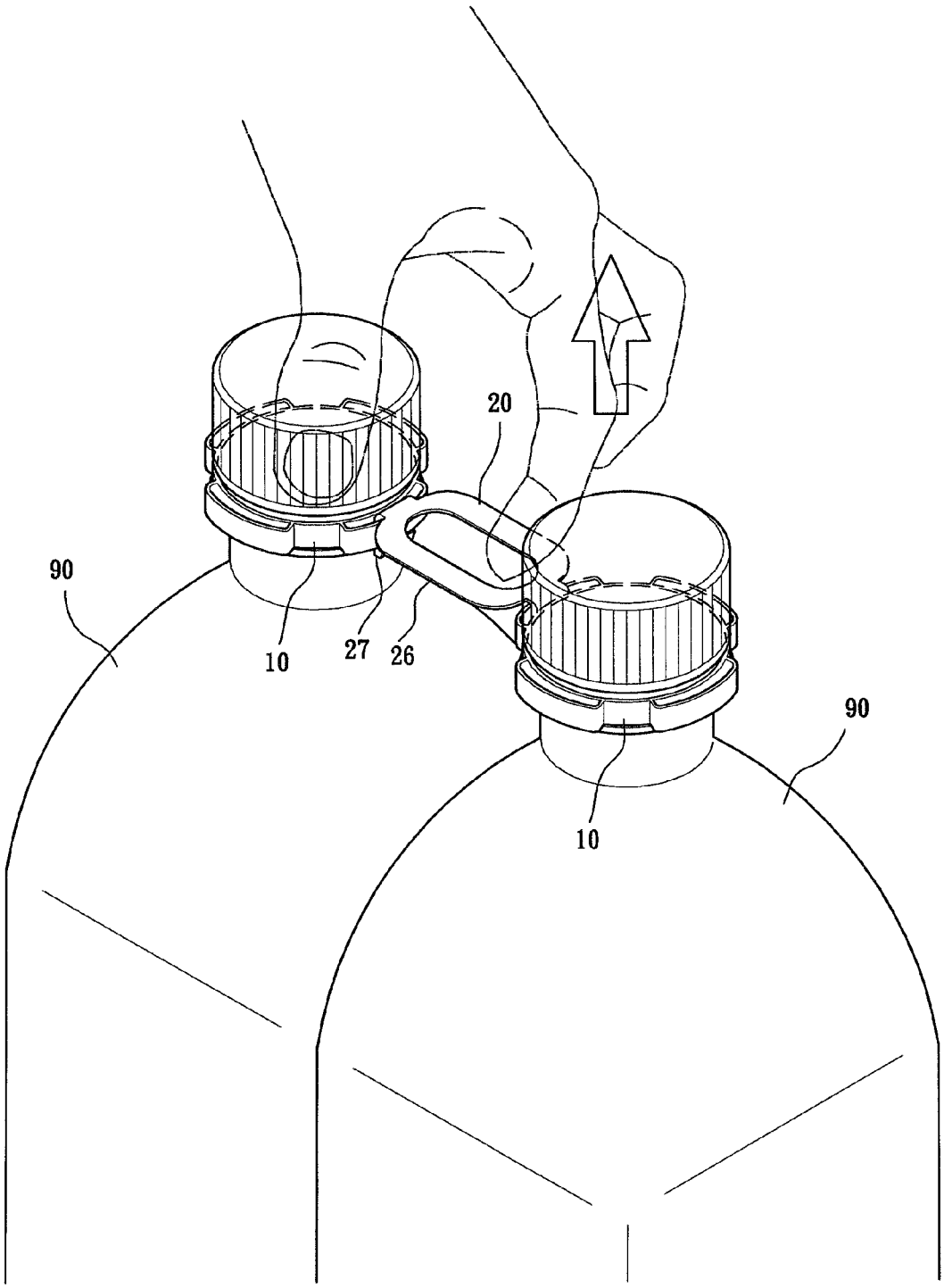
FIG. 10 is a perspective view of the third preferred embodiment of the present invention, showing user holding the connecting device.

FIG. 9 shows a cap ring 10 and a connecting device 20 of the third preferred embodiment, in which the cap ring 10 is the same as the first preferred embodiment. The connecting device 20 of the third preferred embodiment has a ring member 26 and two hooks 27 at opposite sides of the ring member 26. The hooks 27 are perpendicular to the ring member 26 to engage the opening 13 of the cap ring 10. FIG. 10 shows the connecting device 20 of the third preferred embodiment connecting two bottles 90. With the same way, the connecting devices 20 of the third preferred embodiment may connect the bottles 90 in series.

Figure 11:
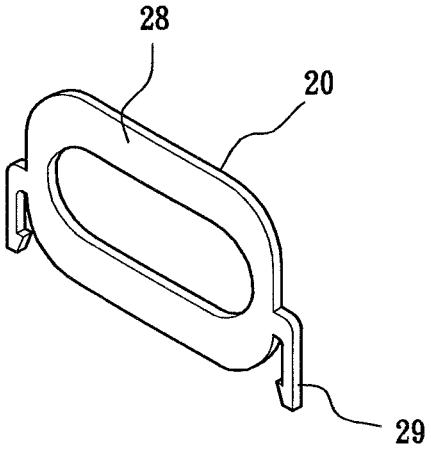
FIG. 11 is a perspective view of the connecting device of a fourth preferred embodiment of the present invention.

FIG. 11 shows a connecting device 20 of the fourth preferred embodiment which has a ring member 28 and two hooks 29 at opposite sides of the ring member 28. The different part is that the hooks 29 are parallel to the ring member 28. The operation and the function of the fourth preferred embodiment are the same as above, so we don't describe it again.

The description above is a few preferred embodiments of the present invention and the equivalence of the present invention is still in the scope of claim construction of the present invention.

What is claimed is:

1. An apparatus for carrying a bottle, wherein the bottle has a cavity and a thread above the cavity, and a cap engages the thread to seal a top opening of the bottle, the apparatus comprising:

a cap ring received in the cavity of the bottle and having at least an opening, wherein the cap ring is initially connected to the cap, and the cap ring is separated from the cap while the cap is turned to open; and a connecting device, which is a strip, being inserted into the opening of the cap ring, and then engaging opposite ends thereof to form a ring, whereby a user holds the connecting device to carry the bottle;

wherein the connecting device and the cap ring are two independent elements;

wherein the connecting device has a post and a bore at opposite ends whereby the post detachably engages the bore to form a ring.

2. An apparatus for carrying a bottle, wherein the bottle has a cavity and a thread above the cavity, and a cap engages the thread to seal a top opening of the bottle, the apparatus comprising:

a cap ring received in the cavity of the bottle and having at least an opening, wherein the cap ring is initially connected to the cap, and the cap ring is separated from the cap while the cap is turned to open; and a connecting device, which is a strip, being inserted into the opening of the cap ring, and then engaging opposite ends thereof to form a ring, whereby a user holds the connecting device to carry the bottle;

wherein the connecting device and the cap ring are two independent elements;

wherein the connecting device has a plug at an end, a socket at an opposite end, a protrusion on the plug, and a slot communicated with the socket whereby the plug is inserted into the socket and the protrusion engages the slot to form a ring.

3. The apparatus as defined in claim 1, wherein the cap ring is provided with at least a rib on an outer side to form the opening.

4. The apparatus as defined in claim 3, wherein the rib is a ring to form the opening therein.

5. The apparatus as defined in claim 2, wherein the cap ring is provided with at least a rib on an outer side to form the opening.

6. The apparatus as defined in claim 5, wherein the rib is a ring to form the opening therein.

* * * * *